US009744541B2

(12) United States Patent
Keren

(10) Patent No.: US 9,744,541 B2
(45) Date of Patent: Aug. 29, 2017

(54) WATER PULSATING DEVICE FOR IRRIGATION SYSTEMS

(75) Inventor: Ron Keren, Kibbutz Hatzerim (IL)

(73) Assignee: Netafim, Ltd., Tel Aviv (IL)

( * ) Notice: Subject to any disclaimer, the term of this patent is extended or adjusted under 35 U.S.C. 154(b) by 372 days.

(21) Appl. No.: 14/130,845

(22) PCT Filed: Jun. 14, 2012

(86) PCT No.: PCT/IB2012/053014

§ 371 (c)(1),
(2), (4) Date: Jan. 3, 2014

(87) PCT Pub. No.: WO2013/008110

PCT Pub. Date: Jan. 17, 2013

(65) Prior Publication Data

US 2014/0138453 A1 May 22, 2014

Related U.S. Application Data

(60) Provisional application No. 61/507,124, filed on Jul. 13, 2011.

(51) Int. Cl.
*B67D 7/72* (2010.01)
*B05B 3/14* (2006.01)
(Continued)

(52) U.S. Cl.
CPC ..... *B05B 3/14* (2013.01); *B05B 1/3006* (2013.01); *B05B 3/16* (2013.01); *B05B 12/06* (2013.01); *B05B 12/087* (2013.01); *B05B 1/083* (2013.01); *B05B 3/06* (2013.01)

(58) Field of Classification Search
CPC ..... Y10T 137/2931; Y10T 137/2978; Y10T 137/3015; Y10T 137/3018;
(Continued)

(56) References Cited

U.S. PATENT DOCUMENTS 1,090,244 A * 3/1914 Staples ..... B67D 1/04 137/209
3,372,899 A * 3/1968 McPherson ..... A01G 25/16 251/26
(Continued)

FOREIGN PATENT DOCUMENTS

FR 760596 A 2/1934
IL 92886 A 7/1995

OTHER PUBLICATIONS

International Search Report dated Oct. 2, 2012 issued in PCT counterpart appication (No. PCT/IB2012/053014).
(Continued)

*Primary Examiner* — Craig J Price
(74) *Attorney, Agent, or Firm* — Womble Carlyle

(57) ABSTRACT

A pulsating device has a chamber for receiving liquid entering the device and gas that occupies an initial volume in the chamber. The liquid entering the chamber compresses the gas and decreases the volume occupied by the gas, thereby increasing the pressure in the chamber. A valve is provided to open above a first threshold pressure to begin a pulse of liquid. The valve closes below a second threshold pressure to end the pulse. The pulsating device has an outlet gate that permits liquid in the chamber to exit the chamber when the pressure in the chamber is greater than the pressure outside the chamber.

19 Claims, 3 Drawing Sheets

(51) Int. Cl.

| | |
|---|---|
| ***B05B 12/06*** | (2006.01) |
| ***B05B 3/16*** | (2006.01) |
| ***B05B 1/30*** | (2006.01) |
| ***B05B 12/08*** | (2006.01) |
| *B05B 1/08* | (2006.01) |
| *B05B 3/06* | (2006.01) |

(58) Field of Classification Search

CPC ..... Y10T 137/3021; Y10T 137/3028; Y10T 137/3031; Y10T 137/86348; Y10T 137/86356; Y10T 137/86364; Y10T 137/86372; B05B 1/083; B05B 12/06; B05B 12/087; B05B 3/14; B05B 1/3006; B05B 3/16; B05B 15/10; B05B 3/049; A01G 25/16; F16K 31/02

USPC ..... 137/154, 169, 175, 176, 177, 179, 180, 137/209, 624.14

See application file for complete search history.

(56) References Cited

U.S. PATENT DOCUMENTS

| | | | | |
|---|---|---|---|---|
| 4,113,181 | A * | 9/1978 | Sheets | B05B 3/0472 239/206 |
| 5,738,136 | A | 4/1998 | Rosenberg | |
| 5,950,676 | A * | 9/1999 | Rosenberg | A01G 25/165 137/624.14 |
| 2007/0119975 | A1* | 5/2007 | Hunnicutt | B05B 3/16 239/200 |
| 2012/0312894 | A1* | 12/2012 | Keren | B05B 1/086 239/101 |

OTHER PUBLICATIONS

Written Opinion dated Oct. 2, 2012 issued in PCT counterpart appication (No. PCT/IB2012/053014).

* cited by examiner

WATER PULSATING DEVICE FOR IRRIGATION SYSTEMS

RELATED APPLICATIONS

This is a 35 USC 371 U.S. National Phase of International Application No. PCT/IB2012/053014, filed 14 Jun. 2012 and published in English as WO 2013/008110A1 on 17 Jan. 2013, which claims priority to U.S. Provisional application No. 61/507,124, filed 13 Jul. 2011. The contents of the aforementioned applications are incorporated by reference in their entirety.

TECHNICAL FIELD

Embodiments of the invention relate to a pulsating device.

BACKGROUND

In such devices, the incoming fluid flow may be of relatively low flow and the ejected pulses may be transformed to be of a relatively high flow. Pulses emitted by pulsating devices can therefore be designed to reach relative large distances in relation to conventional non pulsating devices that would require much higher flow rates in order to reach similar distances. As a result, basing an irrigation system on a pulsating device can reduce some of the expenses associated with such an irrigation system such as for example the energy consumed by the system.

Israeli patent No. 92886 describes a pulsating device with a chamber and a hollow stem that extends through the chamber to an outlet orifice of the chamber. The device also includes a displaceable valve member that is disposed in the chamber under the outlet orifice. Upon rise of pressure in the chamber the valve can be contracted from a position where it closes to the orifice to a position where it is displaced from the orifice to allow a pulse of water to exit the device.

SUMMARY

The following embodiments and aspects thereof are described and illustrated in conjunction with systems, tools and methods which are meant to be exemplary and illustrative, not limiting in scope.

In an embodiment of the present invention there is provided a pulsating device for transforming a liquid flow entering the device from a liquid source upstream to an intermittent pulsating liquid flow ejected from the device downstream, the device comprising a chamber for receiving the liquid flow entering the device and gas that occupies an initial volume in the chamber, the liquid entering the chamber being adapted to compress the gas and decrease the volume that the gas occupies in the chamber and increase the pressure in the chamber, the device further comprises a valve that is adapted to open above a first threshold pressure Po within the chamber to begin a liquid pulse that exists the chamber and after being opened to close below a second threshold pressure Pc within the chamber to end the liquid pulse exiting the chamber, wherein the device also comprises an outlet gate that communicates between the interior and the exterior of the chamber, and the liquid in the chamber can exit the chamber via the outlet gate when the pressure in the chamber at the outlet gate is above zero.

Optionally, the device comprises an inlet gate that is formed in the chamber and communicates between the interior and the exterior of the chamber, and air from outside of the chamber can enter the chamber when the pressure in the chamber at the inlet gate is below zero.

Typically, the pressure of the liquid at the liquid source is greater than the first threshold pressure Po.

Optionally, the flow rate of each pulse at any point between its beginning and end is greater than the flow rate of liquid entering the chamber via the inlet.

If desired, relative to a lower end of the chamber at pressure Po the height of liquid in the chamber is Lo and at pressure Pc the height of liquid in the chamber is Lc which is lower than Lo.

Optionally, relative to a lower end of the chamber at pressure Po the height of liquid in the chamber is Lo and at pressure Pc the height of liquid in the chamber is Lc which is lower than Lo, and the inlet gate communicates with the chamber at a point that is lower than Lc.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
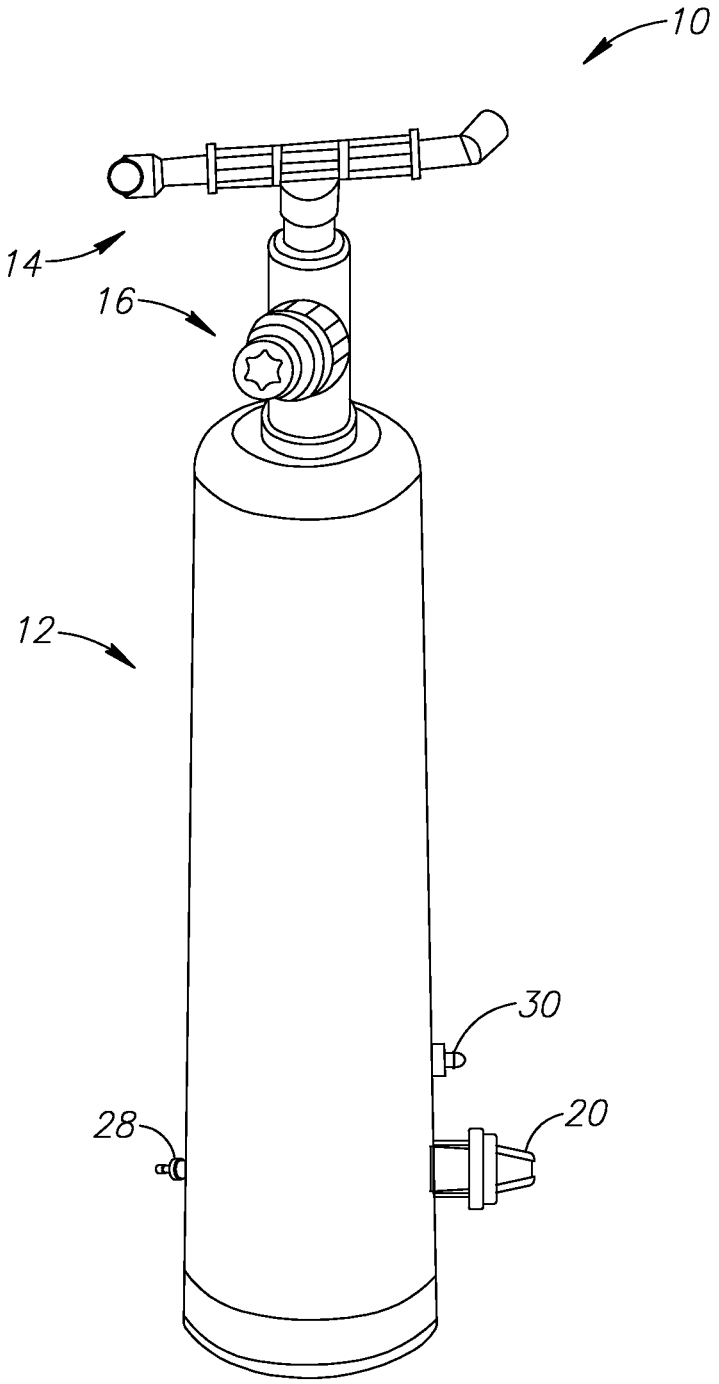
FIG. 1 schematically shows a perspective top view of an embodiment of a pulsating device in accordance with the present invention coupled to an embodiment of a sprinkler in accordance with the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1. A pulsating device 10 in accordance with an embodiment of the present invention is adapted to transform an incoming liquid flow from a liquid source upstream (not shown) to an outgoing liquid pulse that is ejected downstream. The liquid may be water that may contain substances used in agricultural applications in which the device is used such as plant nutrients, pesticides and/or medications; and the liquid source upstream may optionally be a pipe such as an irrigation pipe.

It is noted that references to pressure made herein are all expressed in terms of deviation from the atmospheric pressure that exists in the environment outside of the device which is defined as "zero". Also it is noted that directional terms appearing throughout the specification and claims, e.g. "forward", "rear", "up", "down" etc., (and derivatives thereof) are for illustrative purposes only, and are not intended to limit the scope of the appended claims. Finally it is noted that the directional terms "down", "below" and "lower" (and derivatives thereof) all define identical directions.

Figure 2:
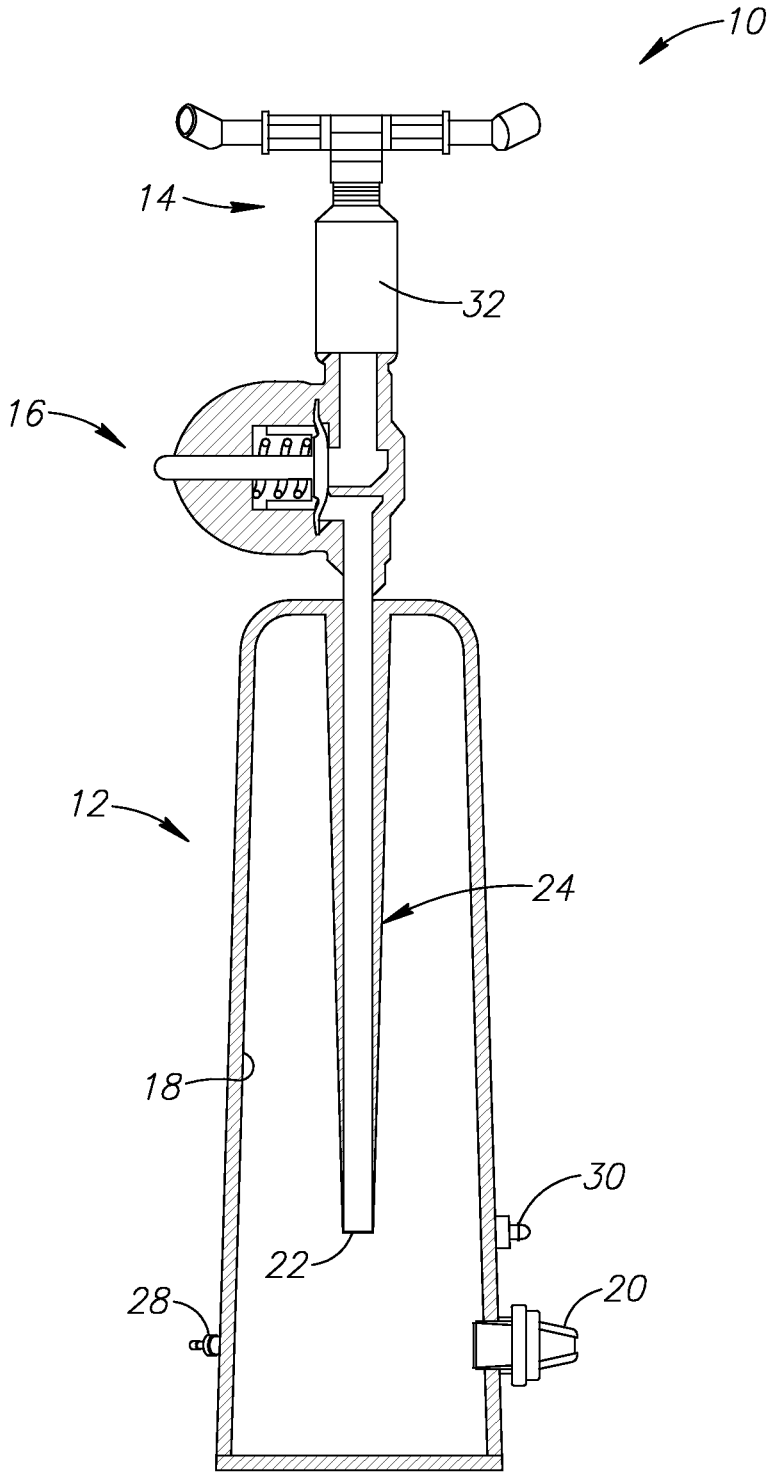
FIG. 2 schematically shows a partial cross sectional view of the pulsating device and sprinkler of FIG. 1.

Attention is additionally drawn to FIG. 2. The pulsating device 10 has a body 12, an emitting portion 14 in an optional form of a sprinkler 32 and a valve 16 that is located therebetween. The body 12 has an inner chamber 18, an inlet 20 and an outlet 22. The inlet 20 leads liquid into the chamber 18 from the liquid source upstream. The outlet 22 is located within the chamber, at an orifice at a lower end of a hollow pipe section 24 of the body 12. The pipe section 24 is fixed relative to the body 12 and does not move relative thereto. Also, the pipe section 24 protrudes into, and terminates within, the chamber 18. The pipe section 24 extends up to above the upper end of the body 12 and provides a passage, i.e., a first exit path, for liquid exiting the chamber 18 via the outlet 22.

Figures 3A, 3B, 3C:
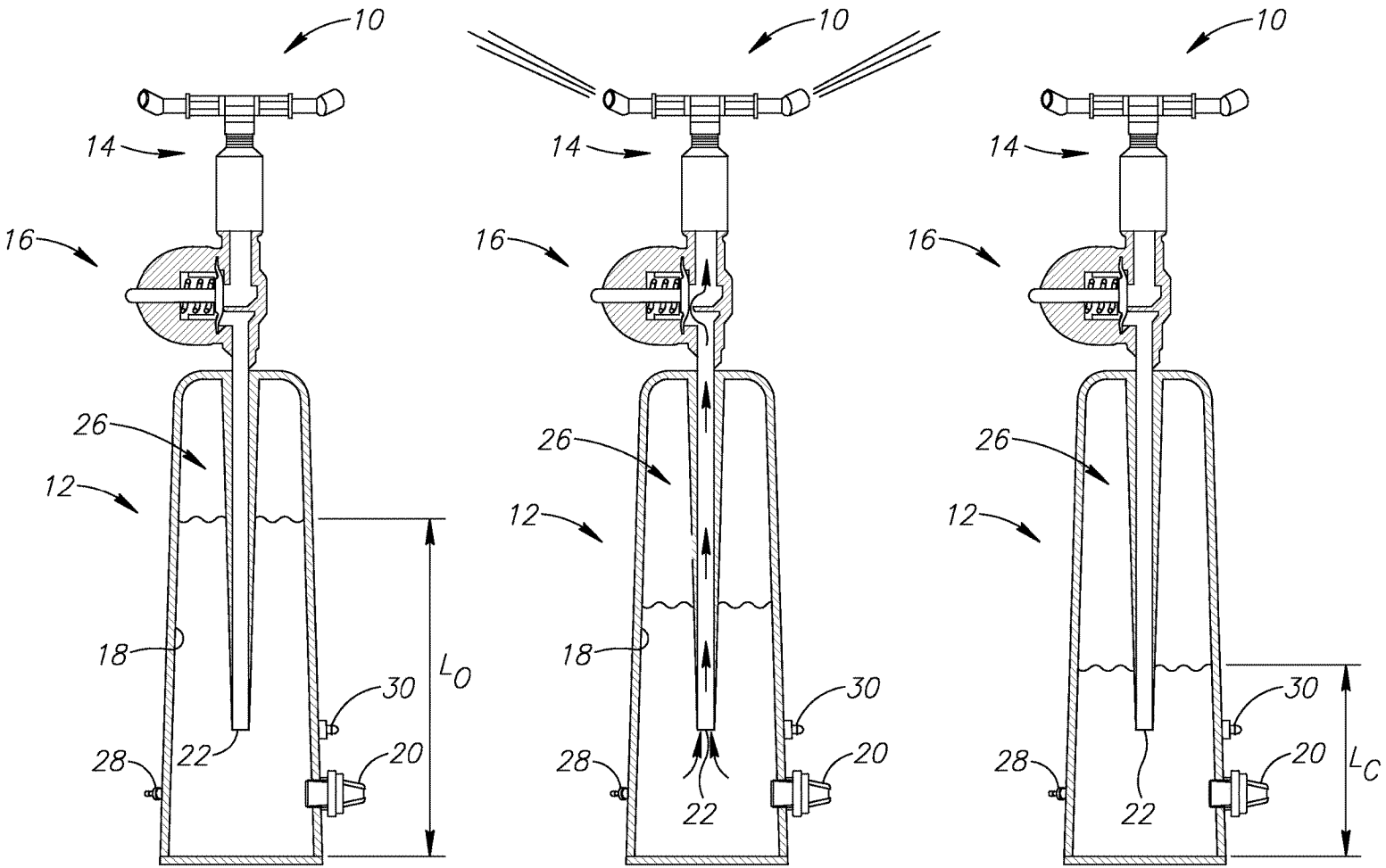
FIGS. 3A to 3C schematically show a partial cross sectional views of the pulsating device and sprinkler of FIG. 1 during different stages of emitting a pulse.

Attention is additionally drawn to FIGS. 3A to 3C. When first starting to use the pulsating device 10 the inner chamber 18 of the device 10 can be substantially empty of liquid and full with a gas 26 such as air (FIG. 2). When irrigation starts liquid enters the chamber 18 via the inlet 20 and starts to fill the chamber 18. The liquid entering the chamber 18 compresses the gas 26 and decrease the volume that the gas 26 occupies in the chamber 18 and thereby increases the pressure in the chamber 18. As long as the pressure at the liquid source is greater than the pressure in the chamber 18, the level of liquid in the chamber 18 and accordingly the pressure in the chamber 18 rises and the gas 26 remains trapped at an upper portion of the chamber 18. The valve 16 which is exposed to the chamber 18 via the pipe section 24 will allow the pressure in the chamber 18 to rise until it reaches a first threshold pressure Po which is the pressure at which the valve 16 opens. The level of the liquid just before the valve 16 opens and as measured from a lower end of the chamber 18 is Lo (FIG. 3A), and the pressure in the chamber 18 will rise to Po only if the pressure at the liquid source is greater than Po.

The valve 16 that opens at pressure Po in the chamber 18 begins a pulse of liquid that starts to exit the chamber 18 and pipe section 24 towards the emitting portion 14 where it is emitted to the outside environment. As liquid exits the chamber 18 the pressure in the chamber 18 drops, the gas 26 that is trapped at the upper portion of the chamber 18 expands and the level of liquid in the chamber 18 decreases (FIG. 3B). The pulse continues until the pressure in the chamber 18 drops and reaches a second threshold pressure Pc where the valve 16 closes and ends the pulse. The second threshold pressure Pc is lower than the first threshold pressure Po and the level of the liquid just before the valve 16 closes and as measured from a lower end of the chamber 18 is Lc which is lower than Lo (FIG. 3C).

As long as the device 10 remains in liquid communication with the pressurized liquid source upstream, the termination of a given pulse will be followed by a subsequent rise of pressure in the chamber 18 (FIG. 3A) which will lead to a subsequent pulse that is released from the chamber 18 and emitted from the device 10 to the outside environment (FIG. 3B) until the pressure drops and the pulse stops (FIG. 3C). In some cases, to ensure that the device 10 forms pulses it is preferable to configure the device 10 such that the flow rate of each pulse being emitted from the chamber 18, at any point between its beginning and end, is greater than the flow rate of liquid entering the chamber 18 via the inlet 20. This reduces the possibility of the formation of an equilibrium in the chamber 18 between the liquid entering the chamber and the liquid exiting it, that may stop the formation of the pulses exiting the chamber 18.

In an embodiment of the present invention it is also possible to configure the inlet 20 to the chamber 18 to be of a regulated type. Such a regulated inlet can ensure that the flow rate of liquid entering the chamber 18 is substantially constant and independent of the pressure differences that are formed between the liquid pressure at the liquid source upstream and the liquid pressure in the chamber 18 that varies during the formation of the pulses. By configuring the liquid flow entering the chamber to a substantially constant rate it is easier to avoid reaching the above mentioned equilibrium between the liquid entering the chamber and the liquid exiting it, that may stop the formation of the pulses.

During experiments with a pulsating device 10 generally similar to that described above, it was observed by the inventor of the present invention that over time at least some of the substances of the gas 26 that is trapped in the chamber 18 may in some cases dissolve into the liquid that it contacts in the chamber 18. This may lead to a drop in the amount of gas 26 that is present in the chamber 18 in gas form and as a result to a decline in the performance of the pulsating device 10. Therefore, in an embodiment of the present invention the pulsating device 10 is equipped with an outlet gate 28 that is adapted to allow liquid in the chamber 18 to seep out of the chamber 18, along a second exit path different from the first exit path, when the pressure in the chamber 18 at the outlet gate 28 is above "zero". And, optionally the pulsating device 10 is also equipped with an inlet gate 30 that is located above the outlet gate 28 and is adapted to allow air to seep into the chamber 18 when the pressure in the chamber 18 at the inlet gate 30 is below "zero", i.e., when the pressure in the chamber 18 is less than the pressure outside the chamber 18.

In embodiments of the pulsating device 10 that include the outlet gate 28, each time the pulsating device 10 is turned off and put to rest between irrigation cycles the chamber 18 can be emptied from its liquid via the outlet gate 28. In embodiments that include also the inlet gate 30 new air can enter the chamber 18 via the inlet gate 30 when it is emptied. When a new irrigation cycle starts by for example renewing the supply of pressurized liquid that enters the chamber 18 via the inlet 20, liquid will again start to fill the chamber 18 and the pulsating sequence will resume.

During a pulsing sequence when the pressure in the chamber 18 varies between the first threshold pressure Po and the second threshold pressure Pc; a small amount of liquid will constantly seep out of the chamber 18 via the outlet gate 28. When irrigation stops, liquid will continue to seep out of the outlet gate 28 as long as there is liquid in the chamber 18 above the outlet gate 28 that forms a pressure greater than "zero" within the chamber 18 at the outlet gate 28. During the emptying of the chamber 18 from liquid the pressure in the gas 26 above the liquid drops to "zero" and then continues to drop to below "zero". When the level of liquid in the chamber 18 reaches a position below the inlet gate 30 and when the pressure above the liquid is below "zero" then the inlet gate 30 will allow air from outside of the chamber 18 to seep into the chamber 18 and "charge" the chamber 18 with new air in gas state.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Although the present embodiments have been described to a certain degree of particularity, it should be understood that various alterations and modifications could be made without departing from the scope of the invention as hereinafter claimed.

The invention claimed is:

1. A pulsating device, for transforming a liquid flow entering the device via an inlet from a liquid source upstream to an intermittent pulsating liquid flow ejected from the device downstream, the device comprising a body having a chamber for receiving the liquid flow entering the device and gas that occupies an initial volume in the chamber, the liquid flow entering the chamber being adapted to compress the gas and decrease the volume that the gas occupies in the chamber and increase pressure in the chamber, the device has a first exit path comprising a first liquid outlet located at an orifice at a lower end of a pipe that protrudes into, and terminates within the chamber, the pipe being in fluid communication with an emitting portion through which intermittent pulsating liquid flow is ejected from the device;

the device further comprises a valve that is adapted to open above a first threshold pressure within the chamber to begin a liquid pulse that exits the chamber via the first exit path, and after being opened, to close below a second threshold pressure within the chamber to end the liquid pulse exiting the chamber, wherein the pipe is fixed to the body and does not move relative to the body, the pipe having an opening within the chamber;

the valve is located outside the chamber, between the body and the emitting portion;

the valve is fixed in position relative to the body;

the valve is perpendicular to the pipe;

the device also has a second exit path which comprises an outlet gate that communicates between an interior and an exterior of the chamber, and the liquid in the chamber can exit the chamber via the second exit path when the pressure in the chamber at the outlet gate is greater than a pressure outside of the chamber; and the first exit path and the second exit path are different from one another.

2. The pulsating device according to claim 1, wherein a pressure of liquid at the liquid source is greater than the first threshold pressure.

3. The pulsating device according to claim 2, wherein the flow rate of each pulse at any point between a beginning and an end of each pulse is greater than the flow rate of liquid entering the chamber via the inlet.

4. The pulsating device according to claim 3, wherein relative to a lower end of the chamber, at the first threshold pressure a height of liquid in the chamber is at a first height, and at the second threshold pressure the height of the liquid in the chamber is at a second height which is lower than the first height.

5. The pulsating device according to claim 1, wherein the gas is air.

6. The pulsating device according to claim 1, wherein the inlet regulates the flow rate of liquid entering the chamber to be substantially constant.

7. The pulsating device according to claim 1, wherein the liquid in the chamber can exit the chamber via the outlet gate and the second exit path when the valve is closed.

8. The pulsating device according to claim 1, wherein the outlet gate is configured to allow a portion of said liquid introduced into the chamber to continuously seep out of the chamber during a pulsing sequence.

9. A pulsating device, for transforming a liquid flow entering the device via an inlet from a pressurized liquid source upstream to an intermittent pulsating liquid flow ejected from the device via an emitting portion downstream, the device comprising a chamber for receiving the liquid flow entering the device and gas that occupies an initial volume in the chamber, the liquid flow entering the chamber being adapted to compress the gas and decrease the volume that the gas occupies in the chamber and increase a pressure in the chamber, the device further comprises a valve that is adapted to open above a first threshold pressure within the chamber to begin a liquid pulse that exits the chamber via the emitting portion, and after being opened, to close below a second threshold pressure within the chamber to end the liquid pulse exiting the chamber via the emitting portion, wherein the valve and chamber are configured such that, so long as the device remains in liquid communication with the pressurized liquid source upstream, the pressure within the chamber repeatedly rises above the first threshold pressure and then drops below the second threshold pressure, thereby causing the valve to repeatedly open and close and allow pulses of liquid to be emitted from the device;

the device also comprises an outlet gate that communicates between an interior and an exterior of the chamber, and the liquid in the chamber can exit the chamber via the outlet gate when the pressure in the chamber at the outlet gate is above zero, the outlet gate being distinct from the emitting portion; and wherein the pulsating device further comprising an inlet gate that is formed in the chamber and communicates between the interior and the exterior of the chamber, and air from outside of the chamber can enter the chamber when the pressure in the chamber at the inlet gate is less than a pressure outside of the chamber.

10. The pulsating device according to claim 9, wherein relative to a lower end of the chamber, at the first threshold pressure a height of liquid in the chamber is at a first height, and at the second threshold pressure the height of the liquid in the chamber is at a second height which is lower than the first height, and the inlet gate communicates with the chamber at a point that is lower than the second height.

11. An irrigation device configured to emit pulses of liquid in response to liquid input into the irrigation device under pressure, the irrigation device comprising:

a body having a chamber;

a first liquid inlet in fluid communication with the chamber, the first liquid inlet connectable to a pressurized liquid source upstream;

a first exit path comprising a first liquid outlet in fluid communication with the chamber, the first liquid outlet connected via a valve to an emitting portion;

a second exit path comprising an outlet gate in fluid communication with the chamber, the outlet gate configured to permit liquid within the chamber to exit the chamber via the second exit path, when pressure within the chamber is greater than pressure outside the chamber; and an air inlet gate configured to permit air from outside of the chamber to enter the chamber when pressure within the chamber at the air inlet gate is less than pressure outside the chamber;

wherein:

the valve is adapted to open, permitting flow along the first exit path, when pressure within the chamber rises above a first threshold pressure;

the valve is adapted to close when pressure within the chamber drops below a second threshold pressure which is lower than the first threshold pressure;

the valve and chamber are configured such that, so long as the device remains in liquid communication with the pressurized liquid source upstream, the pressure within the chamber repeatedly rises above the first threshold pressure and then drops below the second threshold pressure, thereby causing the valve to repeatedly open and close and allow pulses of liquid to be emitted from the device; and the first exit path and the second exit path are different from one another.

12. The irrigation device according to claim 11, wherein, relative to a lower end of the chamber:

at the first threshold pressure a height of liquid in the chamber is at a first height;

at the second threshold pressure, the height of liquid in the chamber is at a second height, which is lower than the first height; and the air inlet gate communicates with the chamber at a height lower than the second height.

13. The irrigation device according to claim 11, wherein the air inlet gate communicates with the chamber at a height higher than a height at which the second liquid outlet communicated with the chamber.

14. The irrigation device according to claim 11, wherein the first liquid inlet is configured to ensure that a flow rate of liquid entering the chamber is substantially constant, independent of a pressure difference between pressure from a liquid source and pressure within the chamber.

15. The irrigation device according to claim 11, wherein the first liquid inlet is configured to permit liquid to flow into the chamber at a rate greater than a rate at which the outlet gate is adapted to permit liquid to flow out of the chamber.

16. The irrigation device according to claim 11, wherein the emitting portion comprises a sprinkler.

17. The irrigation device according to claim 11, wherein the outlet gate is configured to permit liquid within the chamber to exit the chamber via the second exit path, when the valve is closed.

18. The irrigation device according to claim 11, wherein the outlet gate is configured to allow a portion of said liquid introduced into the chamber to continuously seep out of the chamber during a pulsing sequence.

19. The irrigation device according to claim 11, wherein:

the first exit path further comprises a pipe that protrudes into, and terminates within, the chamber, the pipe being in fluid communication with the emitting portion; and the first liquid outlet is located within the chamber, at an orifice at a lower end of said pipe.

* * * * *